US007640600B2

(12) United States Patent
Reder

(10) Patent No.: US 7,640,600 B2
(45) Date of Patent: Jan. 5, 2010

(54) NURSING COVER

(76) Inventor: Michele Reder, 253 Beach 129 St., Belle Harbor, NY (US) 11694

( * ) Notice: Subject to any disclaimer, the term of this patent is extended or adjusted under 35 U.S.C. 154(b) by 0 days.

(21) Appl. No.: 12/027,244

(22) Filed: Feb. 6, 2008

(65) Prior Publication Data

US 2008/0244802 A1 Oct. 9, 2008

Related U.S. Application Data

(60) Provisional application No. 60/888,410, filed on Feb. 6, 2007.

(51) Int. Cl.
*A41D 1/20* (2006.01)

(52) U.S. Cl. ..... 2/104; 2/46

(58) Field of Classification Search ..... 2/104, 2/48, 52, 49.1, 49.2, 51, 46, 207, 88, 92, 2/338, 300, 69, 310–312, 308, 321, 171, 2/DIG. 11, 44, 45; 602/4, 5, 19, 20, 61, 62, 602/75; 128/876, 875, 878, 881, 874, 99.1, 128/100.1; D24/190; D2/860, 627, 634; 450/1, 5, 8, 10, 23, 62, 64, 80, 85; 473/276, 473/212, 215; 224/600, 602, 607, 622, 159, 224/160, 257, 579, 578

See application file for complete search history.

(56) References Cited

U.S. PATENT DOCUMENTS

| | | | | | |
|---|---|---|---|---|---|
| 345,899 | A * | 7/1886 | Hill | 2/92 |
| 522,018 | A * | 6/1894 | Kehlenbeck | 224/159 |
| 1,638,756 | A * | 8/1927 | Wallman | 132/273 |
| 2,460,589 | A * | 2/1949 | Lewis | 602/4 |
| 2,980,426 | A * | 4/1961 | Johnson | 473/63 |
| 4,050,099 | A * | 9/1977 | David | 2/46 |
| 4,188,944 | A * | 2/1980 | Augustyniak | 602/20 |
| 4,285,067 | A * | 8/1981 | David | 2/46 |
| 4,391,277 | A * | 7/1983 | Horvat | 450/68 |
| 4,449,252 | A * | 5/1984 | Sullinger | 2/46 |
| 4,698,854 | A * | 10/1987 | Slimmon | 2/338 |
| 4,712,251 | A * | 12/1987 | Cobble | 2/104 |
| 4,901,713 | A * | 2/1990 | Troeger | 602/4 |
| D310,288 | S * | 9/1990 | Larsch | D2/728 |
| 5,008,960 | A * | 4/1991 | Hemming | 2/104 |
| 5,226,195 | A * | 7/1993 | Pappas, Jr. | 2/338 |
| 5,491,843 | A * | 2/1996 | Naughton | 2/48 |
| 5,575,004 | A * | 11/1996 | Eisele et al. | 2/207 |
| 5,590,422 | A * | 1/1997 | Henderson | 2/171 |
| 5,592,692 | A * | 1/1997 | Larson | 2/104 |
| 5,690,122 | A * | 11/1997 | Weber-Unger | 128/876 |
| 5,911,311 | A * | 6/1999 | Hutchins | 2/49.5 |
| 6,145,131 | A * | 11/2000 | Huff | 2/207 |
| 6,378,135 | B1 * | 4/2002 | Hemming et al. | 2/104 |

(Continued)

*Primary Examiner*—Amy B Vanatta
(74) *Attorney, Agent, or Firm*—West and Associates, A PC; Stuart J. West; Sara Dirvianskis

(57) ABSTRACT

What is described is a sash-style apparatus that can be comprised of two strips of material. The two strips of material can be configured such that in one configuration the first strip of material lies substantially behind the second strip of material and in a second configuration, the two strips of material can be minimally parted to reveal the mother's nipple and allow an infant to breastfeed. The mother can feed and bond with her infant, without exposing her breast.

13 Claims, 8 Drawing Sheets

U.S. PATENT DOCUMENTS 6,770,044 B1 * 8/2004 Joslin ..... 602/4
D497,467 S * 10/2004 Srivastava ..... D2/894
6,986,163 B2 * 1/2006 Dugan ..... 2/69
7,048,160 B2 * 5/2006 Anderson ..... 2/46
7,096,511 B2 * 8/2006 Cohen ..... 2/206
7,568,967 B2 * 8/2009 Smith ..... 450/1

* cited by examiner

NURSING COVER

PRIORITY

This application is related to and claims priority under 35 U.S.C. 119(e) to U.S. Provisional Patent Application No. 60/888,410 filed on Feb. 6, 2007.

BACKGROUND

1. Field of the Invention

This description relates generally to the area of nursing and more specifically to a nursing cover.

2. Background

It is important to the bonding process between mother and child that mothers breastfeed their infants. However, societal norms generally discourage breastfeeding in public without covering the mother's exposed breast. To accommodate this societal norm, most nursing mothers elect to cover both their exposed breast and the nursing infant with a blanket draped over one shoulder.

While the draped blanket accomplishes the task of covering the mother's exposed breast, it detracts from the bonding process between the mother and child, as the nursing infant and mother are unable to easily look at each other and thus bond.

What is needed is an apparatus that allows the child to nurse while both covering the mother's breast and allowing the mother and child to view each other during the nursing process.

SUMMARY

What is described is a sash-style apparatus that can be comprised of two strips of material. The two strips of material can be configured such that in one configuration the first strip of material lies substantially behind the second strip of material and in a second configuration, the two strips of material can be minimally parted to reveal the mother's nipple and allow an infant to breastfeed. In some embodiments, the two strips of material can be bonded together in at least one location and can include a selectively couplable or permanently coupled burping cloth which can be positioned on the shoulder of the nursing mother. Thus, in use, the mother can breastfeed her infant without covering the child's face or head and can immediately burp the child over her shoulder without having to concern herself with re-covering her breast after nursing the infant.

DETAILED DESCRIPTION

Figure 1:
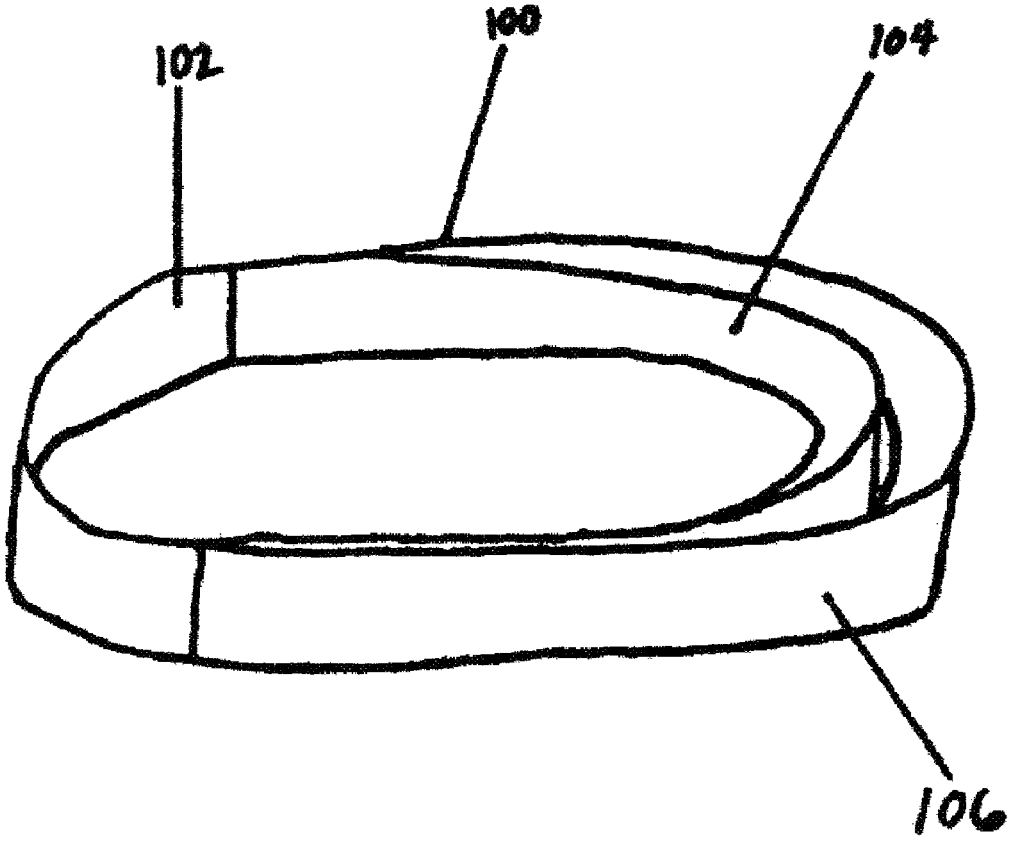
FIG. 1 depicts one embodiment of a nursing cover.

FIG. 1 depicts an embodiment of a sash-style nursing cover 100. In the embodiment shown in FIG. 1, a cover can be comprised of three sections: a shoulder support 102, an interior strip 104, and an exterior strip 106. In the embodiment shown in FIG. 1, the two ends of a shoulder support 102 can be coupled with the two ends of both an interior strip 104 and an exterior strip 106. In the embodiment shown in FIG. 1, an interior strip 104 and an exterior strip 106 can be fixedly coupled with the shoulder support 102 at both ends. However, in alternate embodiments, an interior strip 104, an exterior strip 106 or both can be detachably coupled with a shoulder support 102 either at one end or at both ends.

In the embodiment depicted in FIG. 1 an interior strip 104 can be slightly shorter than an exterior strip 106 and can have the same width. In alternate embodiments, strips 104 and 106 can have different widths. Still in alternate embodiments, strips 104 and 106 can have any known and/or convenient geometric and/or spatial relationship.

In the embodiment depicted in FIG. 1 an interior strip 104 and an exterior strip 106 can be comprised of the same material having the same pattern, color, elasticity, or texture. However, in alternate embodiments, an interior strip 104 can be comprised of different material than an exterior strip 106. An interior strip 104 and/or an exterior strip 106 can be fabric, polymer, elastomeric, or any other known and/or convenient material. In some embodiments, strips 104 and 106 can have different patterns, textures or absorbency properties.

In the embodiment depicted in FIG. 1, a shoulder support 102 can be comprised of an absorbent material adapted to at least partially absorb and/or contain any liquids and/or solids which a baby may expel while being burped. In alternate embodiments, a shoulder strap 102 can be comprised of any other known and/or convenient material.

Figure 1A:
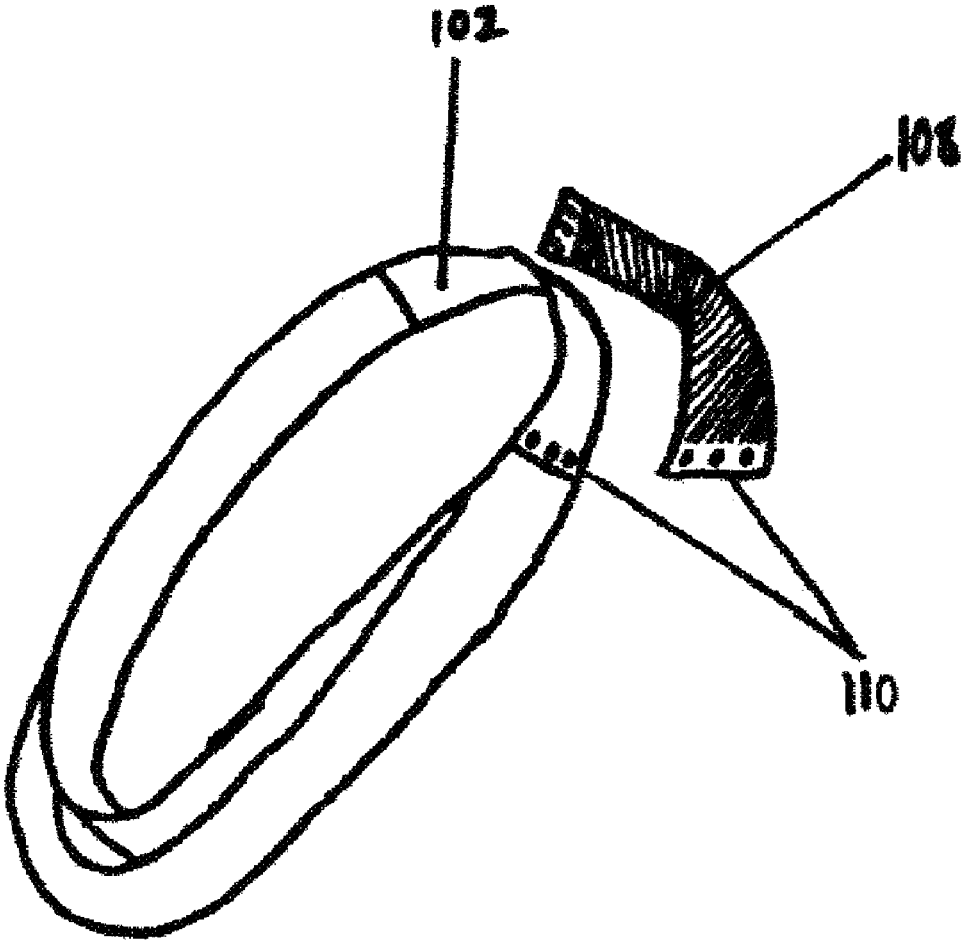
FIG. 1A depicts the nursing cover of FIG. 1 with a detachable cover.

As shown in FIG. 1A, in some embodiments a detachable cover 108 can at least partially cover a shoulder support 102 such that a cover 108 can be easily replaced and/or removed and laundered in the event that it becomes soiled. A detachable cover 108 can be removably connected to a shoulder support 102 via at least one set of complementary fastening components 1 10. Complementary fastening components 110 can be hook-and-loop, snaps, button and slit, or any other known and/or convenient fastening components. In alternate embodiments, a detachable cover 108 can be fabric, polymer, plastic, paper, or any other known and/or convenient at least partially absorbent material. In still further alternate embodiments, a cover 108 can be comprised of disposable material.

Figure 2:
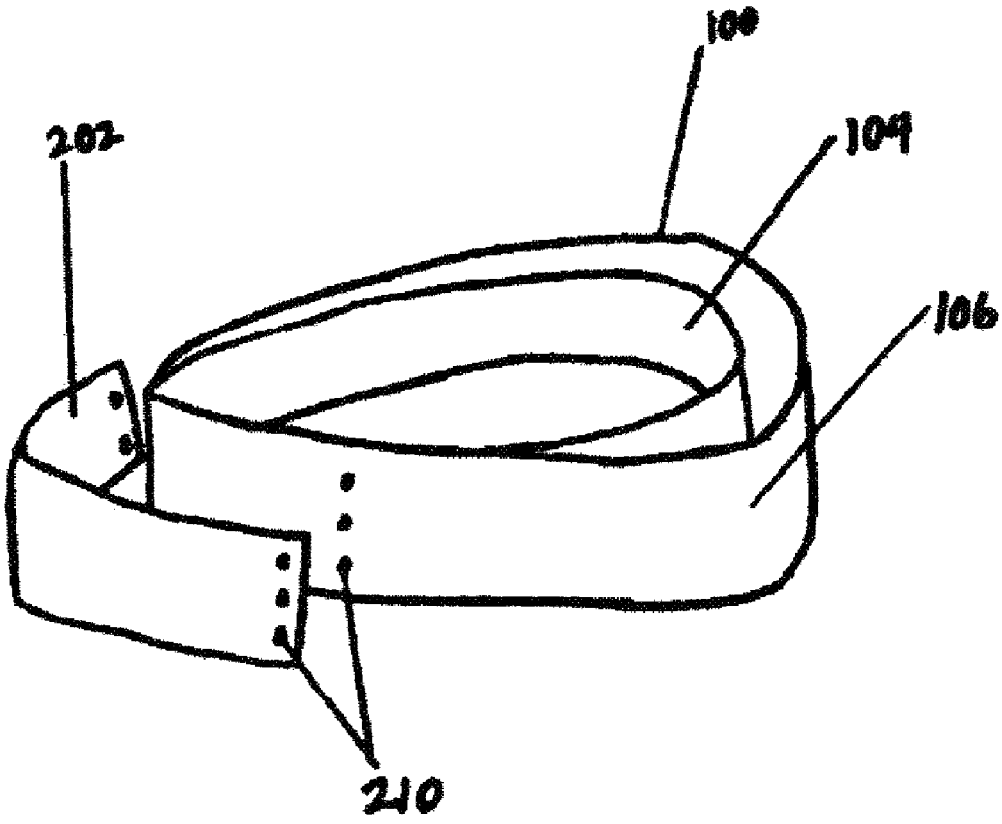
FIG. 2 depicts an alternate embodiment of the nursing cover shown in FIG. 1 with a detachable burping cloth.

FIG. 2 depicts an alternate embodiment of a nursing cover 100 depicted in FIG. 1. In the embodiment shown in FIG. 2, a nursing cover 100 can be comprised of an interior strip 104 and an exterior strip 106 that can be coupled together at their ends. In the embodiment depicted in FIG. 2, strips 104 and 106 are depicted as being fixedly attached not only to each other, but to themselves. However, in alternate embodiments strips 104 and 106 can be individual loops that can be detachably coupled with themselves and/or with each other.

In alternate embodiments, a nursing cover 100 depicted in FIG. 2 can include a burping cover 202. In some embodiments, a burping cover 202 can be a loop of material that can be selectively and/or fixedly, transversely coupled with strips 104 and 106. In some embodiments, a burping cover 202 can be comprised of an absorbent material adapted to at least partially absorb and/or contain any liquids and/or solids which a baby may expel while being burped. In some embodiments, a burping cover 202 can at least partially cover strips 104 and 106 such that a burping cover 202 can be easily replaced and/or removed and laundered in the event that it becomes soiled. In still further alternate embodiments, a burping cover 202 can be comprised of a disposable material and in still further alternate embodiments, a burping cover 202 can be comprised of any known and/or convenient material. A burping cover 202 can be removably connected to a nursing cover 100 via complementary fastening components 210. Complementary fastening components 210 can be hook and loop, snaps, button and slit, or any other known and/or convenient fastening components.

Figure 3:
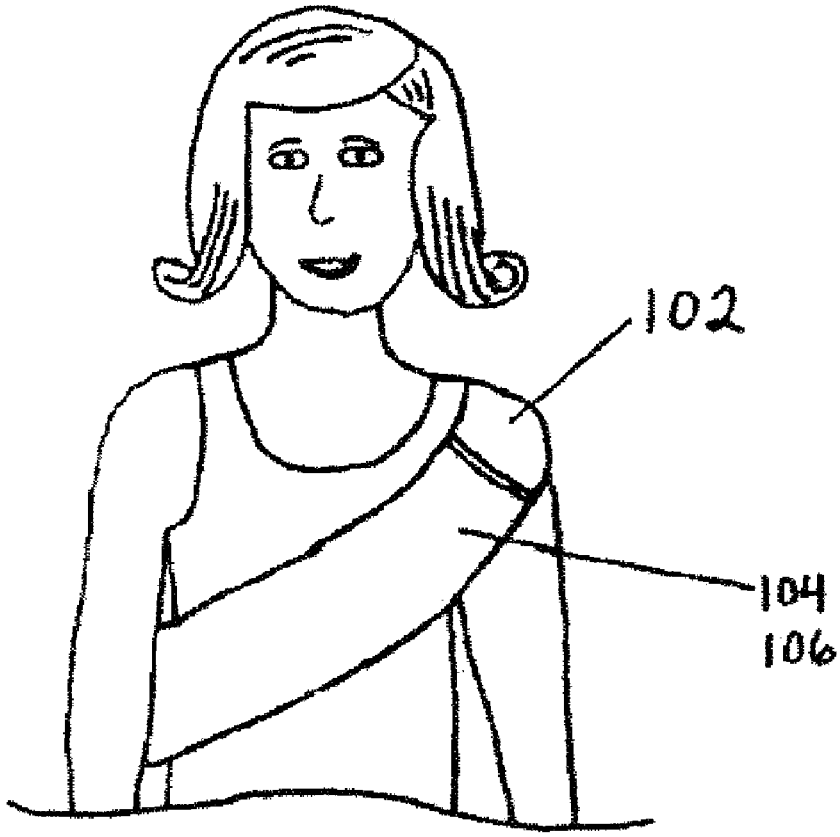
FIG. 3 depicts a first configuration of the nursing cover shown in FIG. 1 as worn by a user.
Figure 4:
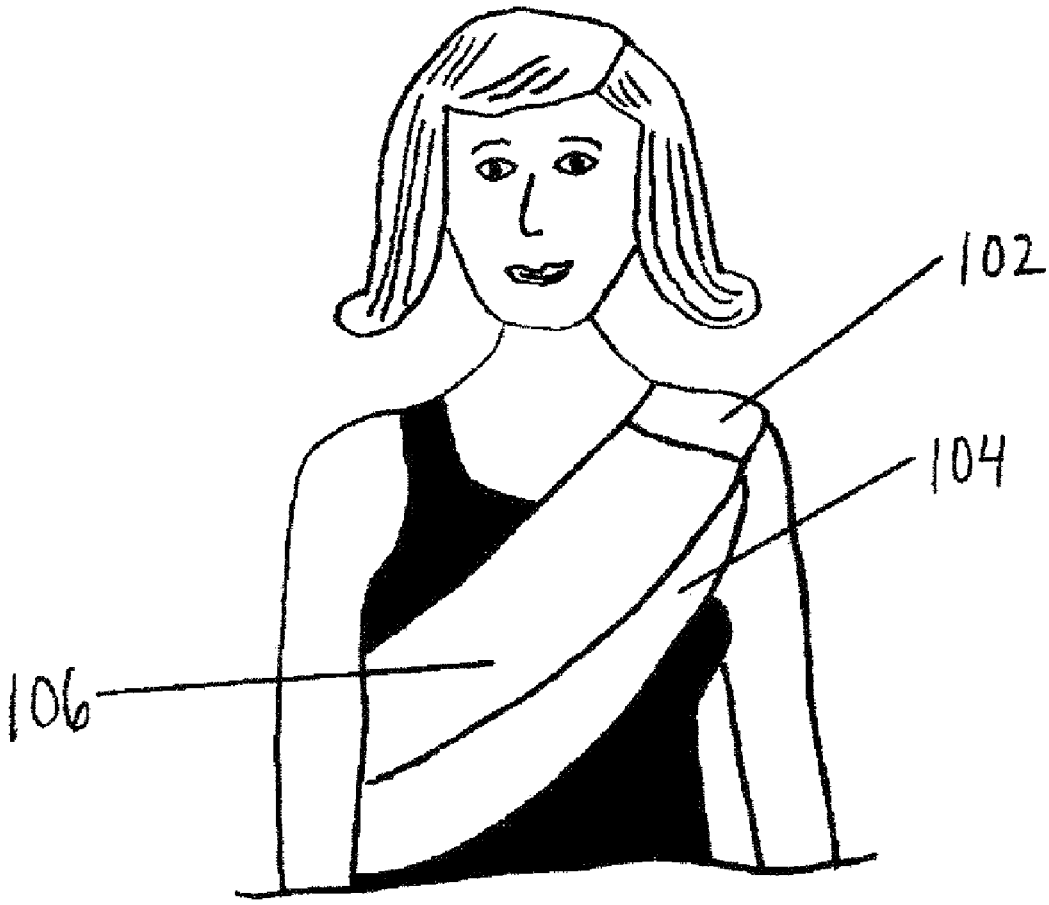
FIG. 4 depicts a second configuration of the nursing cover shown in FIG. 1 as worn by a user.

FIGS. 3 and 4 depict a nursing cover 100 depicted in FIG. 1 in a first configuration (FIG. 3) and a second configuration (FIG. 4). In the configuration depicted in FIG. 3, a nursing cover 100 can be draped across an individual's body and supported on the shoulder of the individual by a shoulder support 102, such that at least one breast of the individual is covered by at least substantially overlapping strips 104 and 106. In the configuration depicted in FIG. 4, a nursing cover 100 can be draped in substantially the same position as depicted in FIG. 3, however strips 104 and 106 no longer need be substantially overlapping.

Figure 5:
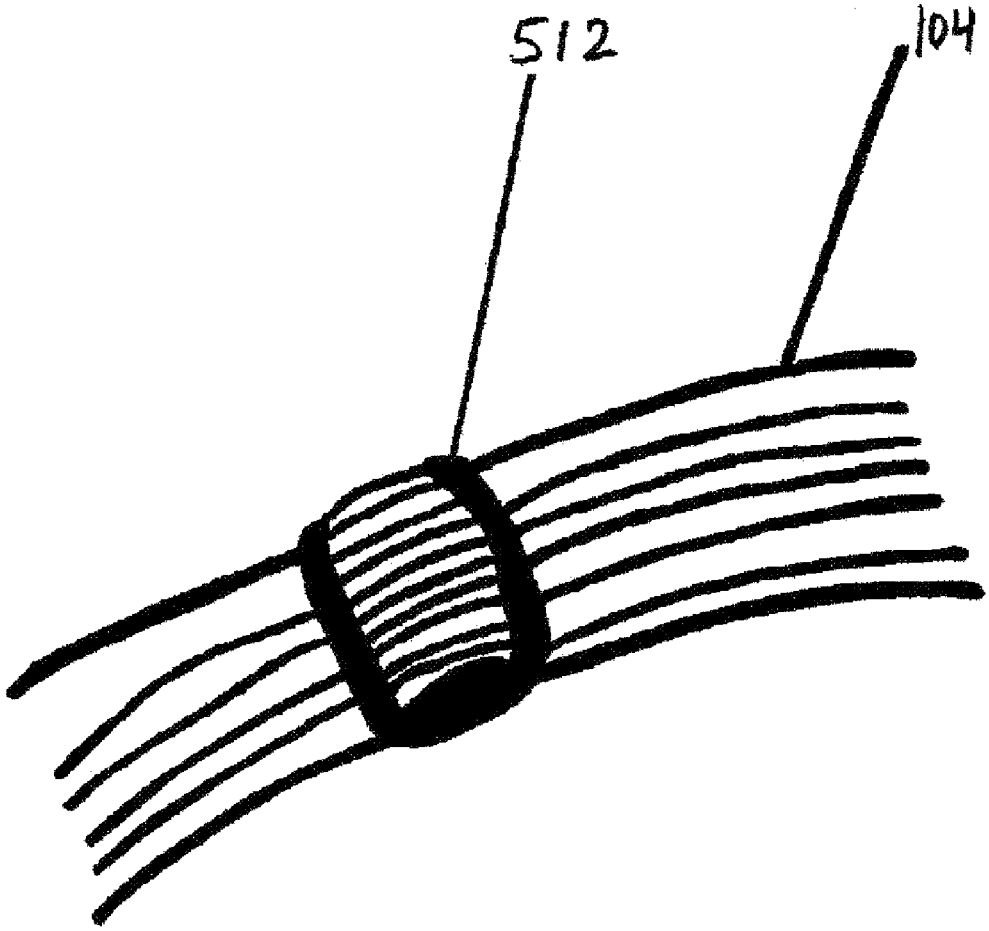
FIG. 5 depicts a portion of a strip having an adjusting mechanism.

FIG. 5 depicts a portion of a strip 104 or 106 of a nursing cover 100. A strip 104 and/or a strip 106 can have an adjusting mechanism 512 to properly adapt to the shape and size of a user's body. An adjusting mechanism 512 can shorten or lengthen a strip 104 and/or a strip 106 and can be metal, plastic, or any other known and/or convenient material. An adjusting mechanism 512 can also be a loop-through type, as shown in FIG. 5, or any other known and/or convenient mechanism for adjusting a length of material.

Figure 6:
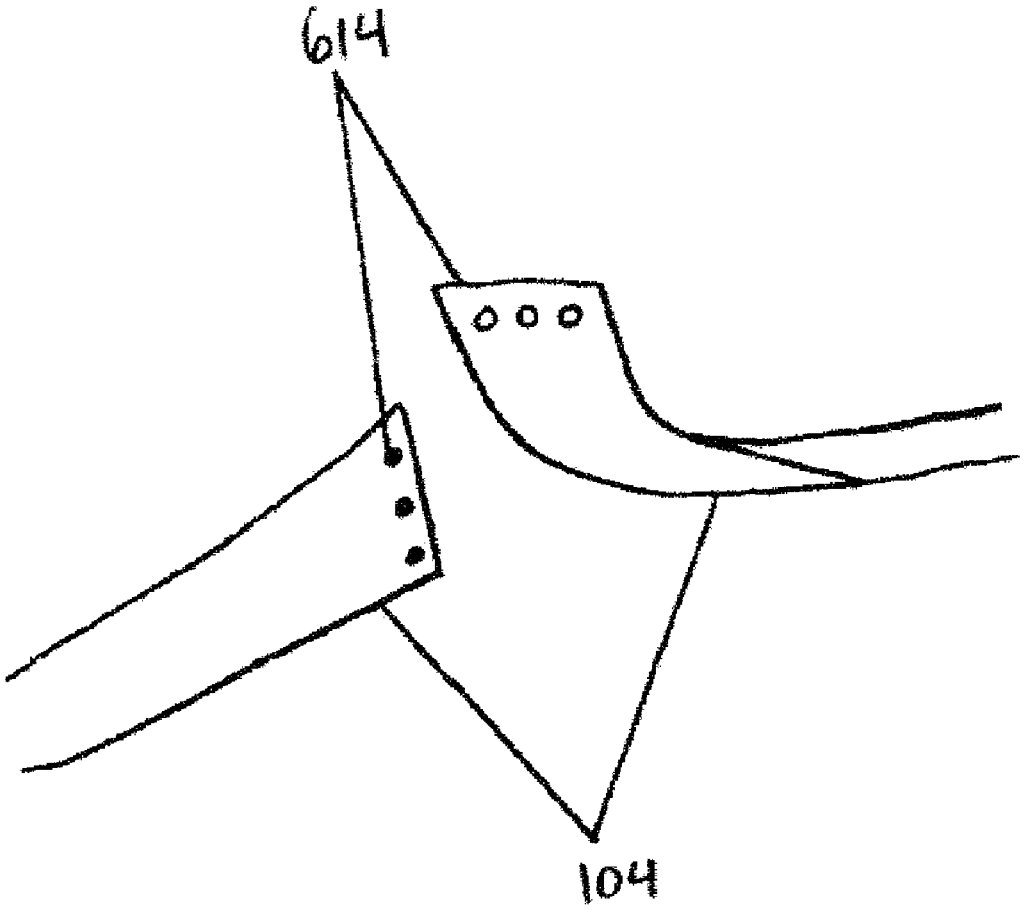
FIG. 6 depicts a portion of a strip having complementary fastening components.

In operation, a user can apply a nursing cover 100 by sliding a nursing cover 100 over the head and shoulders of the user's body, such that a nursing cover 100 is properly wrapped around one shoulder and the torso of the user's body. As shown in FIG. 6, in an alternate embodiment at least one of strips 104 and 106 can be set in place by complementary fastening components 614, thus eliminating the need for over-the-head placement. FIG. 6 depicts a portion of a strip 104 or a strip 106 of a nursing cover 100. A strip 104 and/or a strip 106 can be split at one or more points along its length, and can have complementary fastening components 614 located at or substantially close to the open ends of the split strip. Complementary fastening components 614 can be hook and loop, snaps, button and slit, or any other known and/or convenient fastening components.

Figure 7:
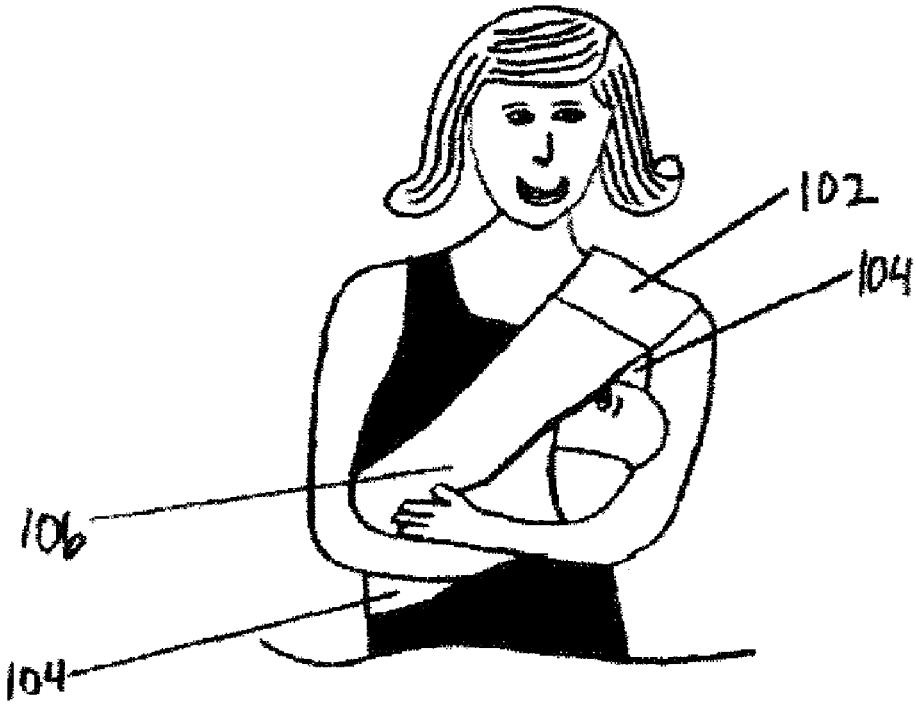
FIG. 7 depicts the nursing cover of FIG. 1 as worn by a user while nursing an infant.

In operation, a nursing mother can prepare her breast for a nursing infant by exposing her breast behind strips 104 and 106. Then the nursing mother can expose her nipple between an interior strip 104 and an exterior strip 106 such that the infant can begin nursing and without substantially exposing her breast and while still allowing the mother and child to bond during the nursing process (as shown in FIG. 7). When the infant is finished nursing the mother can easily reconfigure the strips 104 and 106 such that her nipple is covered and immediately begin to burp the infant over her shoulder, which is covered by a shoulder support 102 and/or detachable cover 108 and/or burping cover 202. When nursing and/or burping is completed, the mother can re-clothe herself beneath strips 104 and 106 and, if desired, reconfigure the strips to be substantially overlapping and/or, if necessary and/or desired, replace a detachable cover 108 and/or burping cover 202.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A nursing cover comprising:

a loop structure comprising an exterior strip of material, an interior strip of material, and a shoulder support;

said exterior strip and said interior strip each comprising two opposing ends;

said shoulder support being coupled with the ends of each of said interior strip and said exterior strip;

said exterior strip and said interior strip being unattached along a substantial portion of the length of each of said exterior strip and said interior strip, such that a space is formed between said strips that allows a child to breastfeed between said strips;

wherein in a first configuration, said exterior strip substantially overlaps said interior strip; and wherein said exterior strip is substantially freely translatable relative to a midlongitudinal portion of said interior strip.

2. The nursing cover of claim 1, wherein at least one of said interior strip and said exterior strip has an adjustment mechanism adapted to selectively shorten or lengthen the strip with which said adjustment mechanism is coupled.

3. The nursing cover of claim 1, wherein at least one of said interior strip and said exterior strip has at least one set of complementary fastening components.

4. The nursing cover of claim 1, wherein said shoulder support is removably attached to a piece of at least partially absorbent material, and said shoulder support and said piece of at least partially absorbent material have at least one set of complementary fastening components.

5. The nursing cover of claim 1, wherein at least one of said interior strip and said exterior strip is fabric.

6. The nursing cover of claim 1, wherein at least one of said interior strip and said exterior strip is absorbent material.

7. The nursing cover of claim 1, wherein in a second configuration, said exterior strip is substantially offset relative to said interior strip.

8. A nursing cover comprising:

a loop structure comprising an exterior strip of material and an interior strip of material;

said exterior strip and said interior strip each comprising two opposing longitudinal edges and two opposing ends;

the ends of said exterior strip and said interior strip being coupled with each other at one common junction;

said exterior strip and said interior strip being unattached at all points along the length of each of said strips, other than where the ends of said strips are coupled, such that a space is formed between said strips that allows a child to breastfeed between said strips;

wherein in a first configuration said exterior strip substantially overlaps said interior strip; and wherein said exterior strip is substantially freely translatable relative to a midlongitudinal portion of said interior strip.

9. The nursing cover of claim 8, wherein a piece of at least partially absorbent material is removably attached to a portion of said exterior strip, and said exterior strip and said piece of at least partially absorbent material have at least one set of complementary fastening components.

10. The nursing cover of claim 8, wherein in a second configuration, said exterior strip is substantially offset relative to said interior strip.

11. The nursing cover of claim 8, wherein at least one of said interior strip and said exterior strip is fabric.

12. The nursing cover of claim 8, wherein at least one of said interior strip and said exterior strip has an adjustment mechanism.

13. A nursing cover comprising:

a loop structure comprising an exterior strip of material, an interior strip of material, and a shoulder support;

said exterior strip and said interior strip each comprising two opposing ends;

said shoulder support being coupled with the ends of each of said interior strip and said exterior strip;

said shoulder support being removably attached to a piece of at least partially absorbent material;

said should support and said piece of at least partially absorbent material having at least one set of complementary fastening components;

wherein in a first configuration, said exterior strip substantially overlaps said interior strip; and wherein said exterior strip is substantially freely translatable relative to a midlongitudinal portion of said interior strip.

* * * * *